US007994738B2

(12) United States Patent
Ger et al.

(10) Patent No.: US 7,994,738 B2
(45) Date of Patent: Aug. 9, 2011

(54) DISPLAY DRIVING CIRCUIT

(75) Inventors: Chih-Chan Ger, Taipei Hsien (TW); Wen-Lin Chen, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 604 days.

(21) Appl. No.: 12/193,761

(22) Filed: Aug. 19, 2008

(65) Prior Publication Data

US 2009/0295763 A1 Dec. 3, 2009

(30) Foreign Application Priority Data

Jun. 2, 2008 (CN) ..... 2008 1 0301926

(51) Int. Cl.
*H05B 37/02* (2006.01)

(52) U.S. Cl. ..... 315/309; 315/291; 315/307

(58) Field of Classification Search ..... 315/209 R, 315/219, 224, 291, 307, 309
See application file for complete search history.

(56) References Cited

U.S. PATENT DOCUMENTS

2008/0054817 A1* 3/2008 Kao et al. ..... 315/209 R
2008/0079371 A1* 4/2008 Kang et al. ..... 315/309
2008/0191638 A1* 8/2008 Kuennen et al. ..... 315/279

* cited by examiner

*Primary Examiner* — Jacob Y Choi
*Assistant Examiner* — Anthony Arpin
(74) *Attorney, Agent, or Firm* — Frank R. Niranjan

(57) ABSTRACT

A display driving circuit includes a temperature compensation adjustment circuit, a control circuit, a full bridge circuit, and a transformation circuit. The temperature compensation adjustment circuit provides a current signal for the control circuit. The value of the current signal changes along with environment temperature changes. The control circuit controls the full bridge circuit based on the current signal. An output voltage signal of the full bridge circuit decreases as the current signal increases, and when the environment temperature decreases. The transformation circuit amplifies the output voltage signal of the full bridge circuit to drive a display.

6 Claims, 1 Drawing Sheet

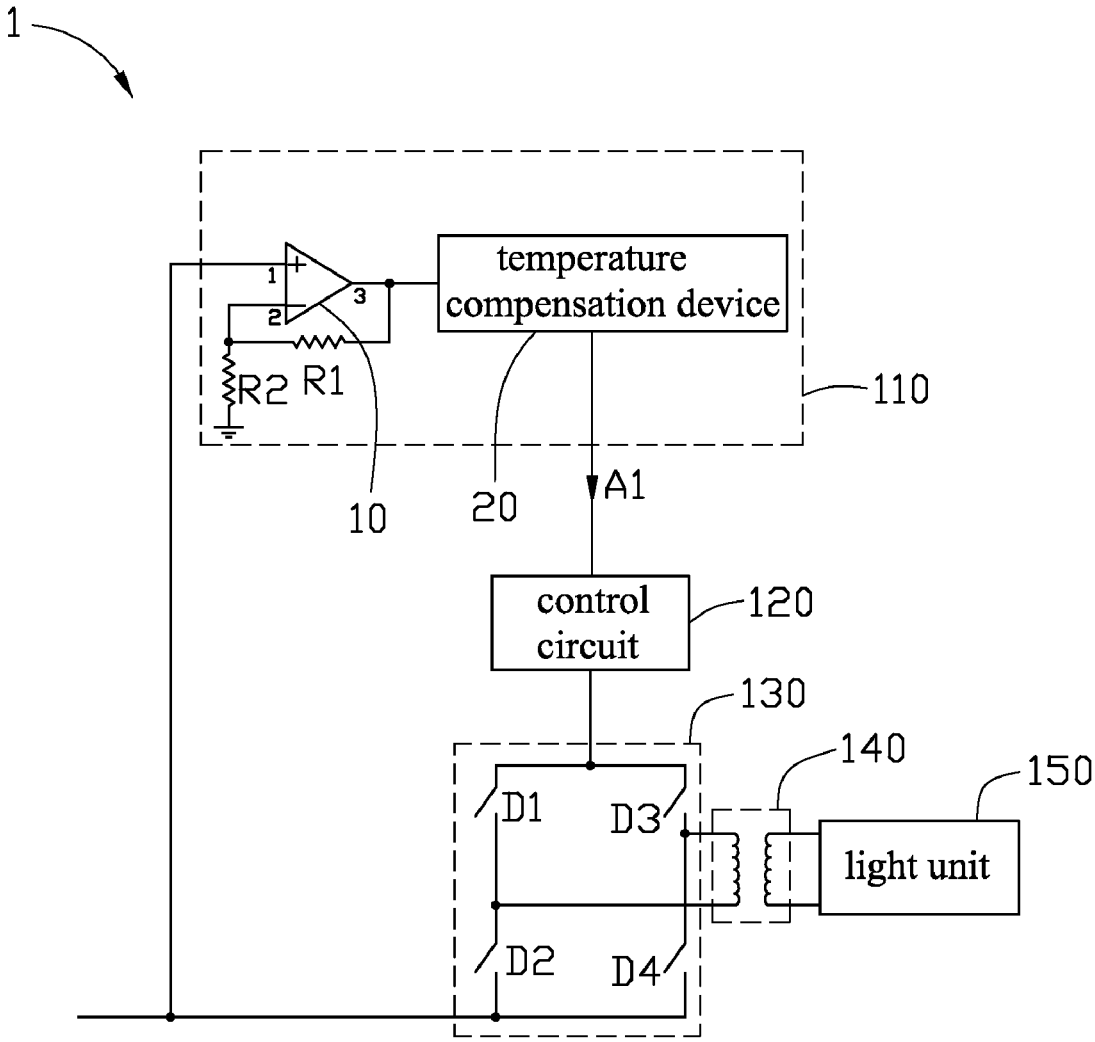
1
temperature compensation device
1
2
3
R2
R1
110
10
20
A1
control circuit
120
130
140
150
D1
D3
D2
D4
light unit

DISPLAY DRIVING CIRCUIT

BACKGROUND

1. Field of the Disclosure

Embodiments of the present disclosure relate to a display driving circuit 1 and, particularly, to a temperature compensated display driving circuit.

2. Description of Related Art

A liquid crystal display (LCD) may include a display unit, a backlight module, and a cold cathode fluorescent lamps (CCFLs) to act as light units within LCDs. The CCFLs emit light only when a display driving circuit provides them with a high voltage. Environment temperature changes significantly influence the current flowing through the CCFLs, which increases as the environment temperature rises, and decreases when the environment temperature decreases. A CCFL may burn out when the environment temperature is too high. However, most display driving circuits cannot adjust the current flowing through the CCFL while the environment temperature changes. Thus, the longevity of CCFLs is shortened.

What is needed, therefore, is to provide a display driving circuit that can amend the aforementioned deficiencies.

SUMMARY

An exemplary display driving circuit includes a temperature compensation adjustment circuit, a control circuit, a full bridge circuit, and a transformation circuit. The temperature compensation adjustment circuit provides a current signal for the control circuit. The value of the current signal changes along with the environment temperature. The control circuit controls the full bridge circuit based on the current signal. An output voltage signal of the full bridge circuit decreases as the current signal increases, and decreases when the environment temperature decreases. The transformation circuit amplifies the output voltage signal of the full bridge circuit to drive a display.

Other advantages and novel features will become more apparent from the following detailed description of certain inventive embodiments of the present disclosure when taken in conjunction with the accompanying drawing, in which:

BRIEF DESCRIPTION OF THE DRAWING

The drawing is a display driving circuit in accordance with one embodiment of the present disclosure.

DETAILED DESCRIPTION

Referring to the drawing, a display driving circuit 1, in accordance with one embodiment of the present disclosure, is used for driving a light unit 150, such as a CCFL. In one embodiment, the display driving circuit 1 includes a temperature compensation adjustment circuit 110, a control circuit 120, a full bridge circuit 130, and a transformation circuit 140.

The temperature compensation adjustment circuit 110 includes an operational amplifier 10, a first resistor R1, a second resistor R2, and a temperature compensation device 20. A pin 1 of the operational amplifier 10 acts as an input terminal of the temperature compensation adjustment circuit 110 and is connected to the full bridge circuit 130. A pin 2 of the operational amplifier 10 is grounded through the resistor R2 and is connected to a pin 3 of the operational amplifier 10 through the resistor R1. The pin 3 of the operational amplifier 10 is connected to a terminal of the temperature compensation device 20. Another terminal of the temperature compensation device 20 acts as an output terminal of the temperature compensation adjustment circuit 110 and is connected to the control circuit 120. In this embodiment, the temperature compensation device 20 is a negative temperature coefficient (NTC) thermal resistor. The resistance of NTC thermal resistor decreases as the environment temperature rises. Thus, an output current signal A1 at the output terminal of the temperature compensation adjustment circuit 110 increases as the environment temperature rises, and decreases when the environment temperature decreases. In other embodiments, the temperature compensation device 20 can be other types of thermal resistors and is needed to indicate that the temperature compensation adjustment circuit 110 along with the temperature compensation device 20, has a temperature compensation function. It may be understood that the operational amplifier 10, the resistor R1 and R2 are optional and may not be included in other embodiments of the present disclosure. The operational amplifier 10, the resistor R1 and R2 are only used for stabilizing the operation of the display driving circuit 1.

The full bridge circuit 130 includes four switch elements D1, D2, D3, and D4. Each switch element can be a transistor, a metal oxide semiconductor field effect transistor, or other types of switch element. The switch elements D1 and D2 are connected in series. The disconnected terminals of the switch elements D1 and D2 act as a first and a second input terminals of the full bridge circuit 130 respectively which are connected to the control circuit 120 and the pin 1 of the operational amplifier 10 respectively. The switch elements D3 and D4 are connected in series. The disconnected terminals of the switch elements D3 and D4 are connected to the first and second input terminals of the full bridge circuit 130 respectively. The connected terminals of the switch elements D1 and D2 act as a first output terminal of the full bridge circuit 130. The connected terminals of the switch elements D1 and D2 act as a second output terminal of the full bridge circuit 130.

The transformation circuit 140 includes a transformer comprising a primary coil and a secondary coil. Two terminals of the primary coil are connected to the first and second output terminals of the full bridge circuit 130 respectively. Two terminals of the secondary coil are connected to the light unit 150.

The control circuit 120 controls the full bridge circuit 130 based on the output current signal A1. An output voltage of the full bridge circuit 130 decreases as the output current signal A1 increases, and decreases when the environment temperature decreases. The transformation circuit 140 amplifies the output voltage of the full bridge circuit 130 to drive the light unit 150. In general, the current flowing through the light unit 150 increases as the environment temperature rises. Therefore, the embodiment of the present disclosure can adjust the current flowing through the light unit 150, and thereby prolonging the longevity of the light unit 150.

It is to be understood that the input terminal of the temperature compensation adjustment circuit 110 can be connected to any point in the embodiment of the present disclosure. For example, it can be connected to the full bridge circuit output terminal and the transformation circuit output terminal.

It is believed that the present embodiment and its advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A display driving circuit for driving a display comprising:

a temperature compensation adjustment circuit for outputting a variable current signal corresponding to environmental temperature changes, the temperature compensation adjustment circuit comprising:

a first resistor;

a second resistor;

an operational amplifier comprising a first terminal connected to the full bridge circuit, a second terminal connected to ground through the second resistor, and a third terminal connected to the second terminal through the first resistor; and a temperature compensation device comprising two terminals connected to the third terminal and the control circuit, respectively;

a full bridge circuit;

a control circuit for controlling the full bridge circuit according to the variable current signal, wherein a voltage output from the full bridge circuit decreases as the variable current signal increases, and increases as the variable current signal decreases; and a transformation circuit for amplifying the voltage output of the full bridge circuit to drive the display.

2. The display driving circuit as claimed in claim 1, the temperature compensation device is a thermal resistor.

3. The display driving circuit as claimed in claim 1, the first terminal is connected to an input terminal of the full bridge circuit.

4. The display driving circuit as claimed in claim 1, the first terminal is connected to an output terminal of the full bridge circuit.

5. The display driving circuit as claimed in claim 1, the first terminal is connected to the transformation circuit.

6. The display driving circuit as claimed in claim 1, wherein the transformation circuit includes a transformer comprising a primary coil and a secondary coil.

* * * * *